United States Patent [19]

Rösl

[11] Patent Number: 4,594,483

[45] Date of Patent: Jun. 10, 1986

[54] IMPULSE GENERATOR

[75] Inventor: Wolfgang Rösl, Eckental, Fed. Rep. of Germany

[73] Assignee: International Standard Electric Corporation, New York, N.Y.

[21] Appl. No.: 611,304

[22] Filed: May 17, 1984

[30] Foreign Application Priority Data

May 28, 1983 [DE] Fed. Rep. of Germany ..... 3319404

[51] Int. Cl.[4] ..... H01H 19/60

[52] U.S. Cl. ..... 200/6 B; 200/61.39; 200/336

[58] Field of Search ..... 200/6 B, 1 B, 291, 77, 200/290, 73, 68.1, 61.39, 276, 11 R, 336

[56] References Cited

U.S. PATENT DOCUMENTS 4,282,415 8/1981 Shimizu et al. ..... 200/77

FOREIGN PATENT DOCUMENTS 3136598 3/1983 Fed. Rep. of Germany .

*Primary Examiner*—G. P. Tolin

*Assistant Examiner*—Morris Ginsburg

*Attorney, Agent, or Firm*—T. L. Peterson; J. S. Christopher

[57] ABSTRACT

An impulse generator includes two pairs of contacts and one indexing disk whose indexing notches are capable of moving a central resilient indexing element. The indexing element moves either toward the one or the other pair of contacts depending on the rotation of the indexing disk. Each pair of contacts is a separate contact spring assembly (15, 16; 17, 18). The indexing disk is positioned above the contact springs (15, 16; 17, 18). The indexing element is a spiral spring (10) clamped either at one or at both ends, and disposed in such a way that the centerline (14) thereof extends in relation to the indexing notches (12' and 12) so that the latter deflects the spiral spring (10) laterally toward the contact springs (15, 16; 17, 18). The spiral spring (10) is laterally deflected to actuate the respective inner contact spring (16, 17) of a contact spring assembly (15, 16; 17, 18). This results in reduced abrasive by wear of the indexing disk, and insures that a good electrical contact is reliably made.

9 Claims, 6 Drawing Figures

IMPULSE GENERATOR

The present invention relates to an impulse generator.

Such an impulse generator is known from the German published Patent Application (DE-OS) 31 36 598. There the two contact pairs consist of contacts disposed on one center spring and on two outer contact springs. The center contact spring can be deflected by a studded disk directly toward both sides thus coming into an operational connection with the respective outermost contact spring. Upon further rotation, the end of the center contact spring slips over the detent of one tooth and jumps into a center position in which the contacts of the center contact spring do not meet with any contact of the outer spring.

It is the object of the present invention, without involving any considerable investment, to keep the wear of the indexing notches as small as possible, and yet to provide an unobjectionable indexing feel and to safeguard a good contact-making with as little bouncing as possible.

This object is achieved by an impulse generator having two pairs of contacts which are positioned in a mutually spaced relationship. An indexing element is provided between the contact springs. The indexing element is capable of being resiliently deflected in two opposing directions. Upon being deflected in any one of the directions, the indexing element closes one of the two pairs of contacts. Furthermore, there is an indexing disk with notches that are oppositely coupled to the indexing element to deflect it toward a selected one of the contacts. Each of the contacts forms an independent contact spring assembly. The spring assemblies generally lie in a plane. The indexing disk is either disposed above the spring assemblies in within the plane defined by them or is disposed adjacent on one side of the contact springs. The indexing element is a spiral or coil spring which is clamped at least at one end and is disposed such that the longitudinally axis of the spiral spring lies in a direction substantially parallel to the dihedral notch formed in the indexing disk. The notches are defined by adjacent teeth. The teeth are capable of deflecting the spiral spring toward a selected one of the contact spring assemblies. When sufficiently deflected, the spiral spring actuates or closes the contact spring assembly toward which it is deflected.

Figure 1:
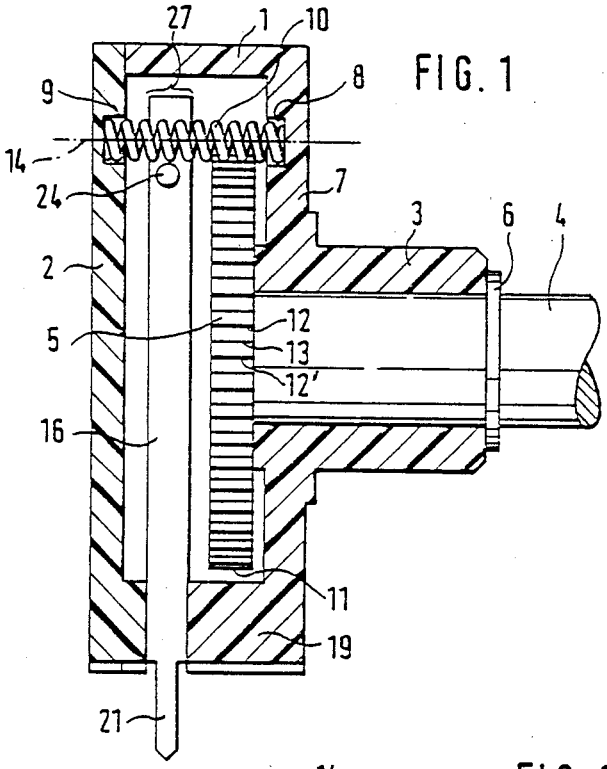
Figure 2:
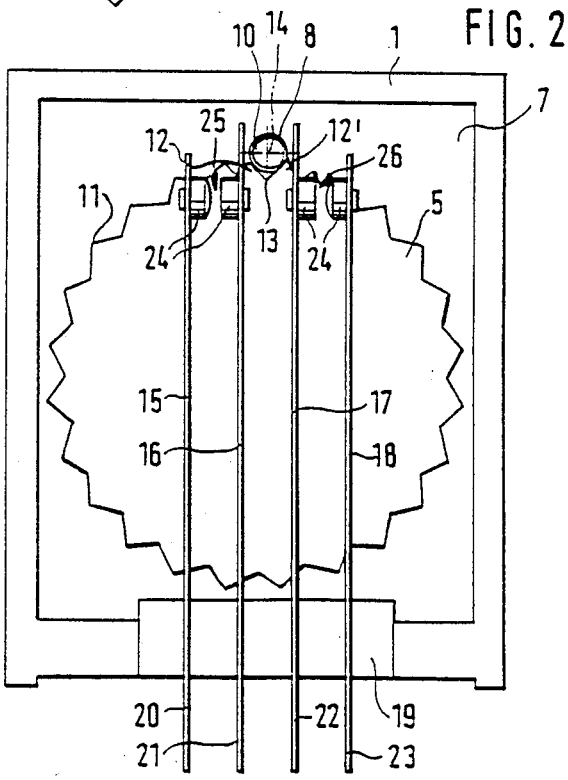
Figure 3:
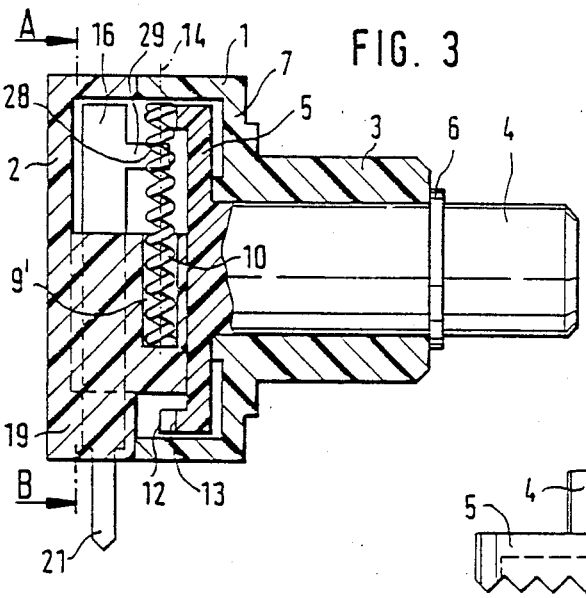
Figure 5:
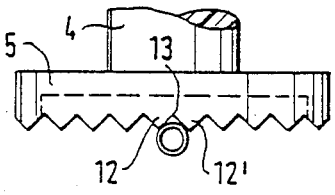
Figure 4:
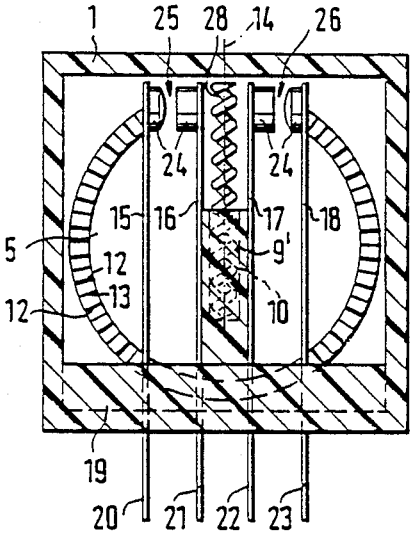
Figure 6:
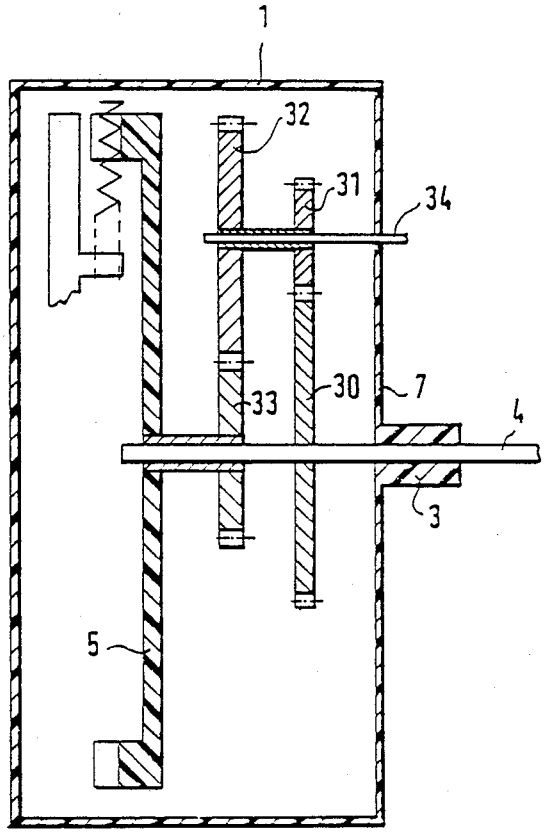

Further advantageous details of the invention will now be described hereinafter with reference to examples of embodiment shown in FIGS. 1 to 6 of the accompanying drawings, in which:

FIG. 1 is the sectional sideview of an impulse generator according to the invention, employing a vertical spiral spring, FIG. 2 is a bottom view with the housing plate removed, FIG. 3 is a sectional sideview of an embodiment employing a radial spiral spring, FIG. 4 is a sectional view taken on line A–B of FIG. 3, FIG. 5 is a partial view of the indexing disk as shown in FIGS. 3 and 4, and FIG. 6 is a basic diagram of an impulse generator employing a spur-gear system.

In FIGS. 1 and 2, the reference numeral 1 indicates a pot-shaped housing member which is capable of being closed with the aid of a housing plate 2 preferably in a tight manner. To the housing member 1 there is moulded or mounted a bearing bushing 3 in which a shaft 4 of an indexing disk 5 is pivotly mounted, but undisplaceable owing to the use of a lock washer 6.

Between the top 7 of the housing member 1 and the housing plate 2, in the cavities 8, 9 thereof, there is inserted a spiral spring 10 serving as an indexing element, either without or with only a slight pretension (bias). This spiral spring is disposed in such a way that it, within the area of the one clamping point, hence for example of the recess 8, is capable of coacting with the indexing notches 12 and 12' as provided for on the face 11 of the indexing disk 5, that is, that it either without or with a slight initial stress engages into a dip 13 between two indexing notches 12. The centerline 14 of the spiral spring 10 extends vertically in relation to the indexing notches 12 and, moreover, in this particular case, parallel in relation to the shaft 4.

In FIG. 2, above the indexing disk 5, four contact springs 15, 16, 17, 18 can be seen which are mounted in the lower, straightly extending housing wall 19, e.g. by being embedded or moulded therein, and project as terminals 20, 21, 22, 23 downwardly out of the housing member 1 or the housing wall 19. The contact springs 15, 16, 17, 18 are provided with contacts 24, and each time two contact springs 15, 16 and 17, 18 form one pair of contacts 25 or 26.

The spiral spring 10 is in such a way disposed between the inner contact springs 21 and 22 that, when it engages a dip 13, none of the springs is actuated. When the indexing disk 5 as shown in FIG. 2, is turned to the left, hence in the anticlockwise direction, then the spiral spring 10 is at first deflected to the left and, with its section 27, between the indexing point (engagement of the spiral spring 10 to the indexing notch 12 or the dip 13), preferably between the center and the other clamping point, hence the recess 9, takes along the contact spring 16. In the course of this, the spiral spring 10 is tensioned. Finally, the contacts 24 of the contact springs 15, 16 touch each other and establish the contact. In this way there is increased the reset force acting upon the spiral spring. By this reset force and the inherent tension of the spiral spring 10, the latter is finally deflected via the engaging indexing notch 12' toward the outside, and jumps into the successively following dip 13. In this way the spiral spring 10 is practically caused to reassume its normal position, just like the contact spring 16. The pair of contacts 25 is thus separated again. In the same way, the pair of contacts 26 is actuated when the indexing disk 5, in the showing of FIG. 2 is turned to the right, hence in the clockwise direction. In this way, the left-right-recognition is achieved by pairs of contacts 25, 26 which are completely separated from one another. Since the spiral spring 10 is applied with a relatively large radius to the indexing notches 12, the wear from abrasion is kept at a low level, and yet there is achieved a good indexing (engaging) effect which, in turn, safeguards a good contact-making.

In the example of embodiment as shown in FIGS. 3 to 5, both the indexing notches 12 and the dips 13 in the direction of the shaft 4 are disposed in such a way as to point towards the contact springs 15, 16, 17, 18. Relative thereto, the spiral spring 10, between the indexing disk 5 and the contact springs 15, 16, 17, 18, is disposed in parallel or at least almost in parallel with the disk's plane. It is inserted at one end in a recess 9' of the housing plate 2, and its free end 28, if so required with a slight initial tension, is positioned in a dip 13. A tab 29 moulded to and extending from the inner contact springs 16, 17, can be taken along by the spiral spring 10. The mode of operation corresponds to that as already described hereinbefore with reference to the previous example.

In accordance with an advantageous embodiment of the invention, the indexing disk may be driven via a transmisison gear, preferably a spur-gear system. Such a gear system, acting in two planes, is schematically shown in FIG. 6. It is accommodated between the top of the housing 7 and the indexing disk 5 in a space-saving manner. A spur gear 30 having a suitable diameter and a suitable number of teeth, which is connected to the shaft 4 and is driven by the latter, drives a smaller spur gear 31. To the latter there is rigidly coupled a larger spur gear 32 which, in turn, drives a smaller spur gear 33 which is rigidly coupled to the indexing disk 5. In this case, the shaft 4 simultaneously serves as the bearing of the indexing disk 5 together with the spur gear 33. The spur gears 31, 32 are seated on a shaft 34 moulded or attached to the housing member 1.

Many modifications and alternations may be made by those having ordinary skill in the art without departing from the spirit or scope of the invention. For example, instead of the spiral spring 10, it is possible to provide a contact actuating member capable of being resiliently deflected in both the indexing direction and the contact-actuation direction. In the most simple case, this is a resilient rod which may be clampled into position either at one or at both ends, like the spiral spring. However, there may also be provided a rigid rod which is resiliently clamped at one end or supported at one end in such a way as to be capable of being resiliently deflected in all directions.

I claim:

1. An improvement in an impulse generator, said impulse generator having two pairs of contacts disposed with respect to each other in a spaced relationship, an indexing element disposed between said pairs of contacts, said indexing element arranged and configured to be resiliently deflected toward either one of said two pairs of contacts and operable in combination with each pair of contacts to close a corresponding one of said pairs of contacts when said indexing element has been deflected toward said corresponding pair of contacts by a predetermined degree, and an indexing disk provided with a plurality of teeth and dihedral notches, said indexing disk disposed in operable engagement with said indexing element to deflect said indexing element toward a selected one of said two pairs of contacts, said improvement comprising:

wherein each pair of contacts is a contact spring assembly, each contact spring assembly being independent from another one of said two pairs of contacts;

wherein said indexing disk is disposed adjacent said pairs of contacts;

wherein said indexing element is a spiral spring, at least one end of said spiral spring being fixed with respect to said two pairs of contacts, said spiral spring characterized by a longitudinal axis, said longitudinal axis disposed adjacent to and in a direction parallel to said dihedral notches defined in said indexing disk, said plurality of teeth and notches being alternately defined in said indexing disk, said indexing disk having a width and two adjacent teeth defining therebetween a dihedral notch, said teeth of said indexing disk contacting said spiral spring to deflect said spiral spring toward a selected one of said contact spring assemblies, whereby said selected one of said contact spring assemblies is actuated, whereby abrasion of said spring and indexing disk is minimized, whereby positive engagement is effectuated with said spiral spring, and whereby reliable activation of said contact spring assembly is assured.

2. The improvement of claim 1 wherein said teeth of said indexing disk are defined on an outer radial surface of said disk, wherein said disk has an axis of symmetry, and wherein said spiral spring is disposed such that said longitudinal axis of said spiral spring extends in a direction parallel to said axis of symmetry of said indexing disk.

3. The improvement of claim 1 wherein the teeth of said indexing disk are disposed along a periphery of said disk, wherein said disk is generally planar and defines a plane of said disk and an axis of symmetry, said teeth of said disk extending out of said plane of said disk, said teeth extending generally in a direction parallel to said axis of symmetry of said disk, said teeth extending toward said two pairs of contacts, said spiral spring extending between said indexing disk and said two pairs of contacts and said longitudinal axis of said spiral spring being approximately parallel to said plane of said disk.

4. The improvement of claim 1 wherein said spiral spring has two opposing ends and is fixed at one of said ends and wherein said teeth of said indexing disk engage another one of said ends of said spiral spring, said other one of said ends of said spring being free.

5. The improvement of claim 1 wherein said spiral spring has two opposing ends and is fixed at each end wherein said teeth of said indexing disk contacts the spiral spring between said ends.

6. The improvement of claim 5 wherein said teeth of said indexing disk engage said sprial spring near one of said fixed ends and wherein said contact spring assemblies are actuated by contact with said spiral spring at the portion of said spiral spring between the contact on said indexing disk and spiral spring on one hand and an opposing fixed end of said spiral spring on the other hand.

7. An improvement in an impulse generator, said impulse generator having two pairs of contacts disposed with respect to each other in a spaced relationship, an indexing element disposed between said pairs of contacts, said indexing element arranged and configured to be resiliently deflected toward either one of said two pairs of contacts and operable in combination with each pair of contacts to close a corresponding one of said pair of contacts when said indexing element has been deflected toward said corresponding pair of contacts by a predetermined degree, and an indexing disk provided with a plurality of teeth and dihedral notches, said indexing disk disposed in operable engagement with said indexing element to deflect said indexing element toward a selected one of said two pairs of contacts, said improvement comprising:

a housing comprised of a plurality of connecting walls forming an enclosure;

wherein said two pairs of contacts are inserted into a selected wall of said housing by having throughgoing terminals projecting through said wall and extending outside said enclosure of said housing;

wherein each pair of contacts is a contact spring assembly, each contact spring assembly being independent from another one of said two pairs of contacts;

wherein said indexing disk is disposed adjacent said pairs of contacts; and wherein said indexing element is a spiral spring, at least one end of said sprial spring being fixed with respect to said two pairs of contacts, said spiral spring characterized by a longitudinal axis, said longitudinal axis disposed in a direction parallel to said dihedral notches defined in said indexing disk, said spiral spring disposed adjacent to at least one of said dihedral notches defined in said indexing disk, said plurality of teeth and notches being alternately defined in said indexing disk, said indexing disk having a width and two adjacent teeth defining therebetween a dihedral notch, said teeth of said indexing disk contacting said spiral spring to laterally deflect said spiral spring to a selected one of said contact spring assemblies, whereby said selected one of said contact spring assemblies is actuated, whereby abrasion of said spiral spring and indexing disk is minimized, whereby positive engagement is effectuated with said spiral spring, and whereby reliable activation of said contact spring assembly is assured.

8. An improvement in an impulse generator, said impulse generator having two pairs of contacts disposed with respect to each other in a spaced relationship, an indexing element disposed between said pairs of contacts, said indexing element arranged and configured to be resiliently deflected toward either one of said two pairs of contacts and operable in combination with each pair of contacts to close a corresponding one of said pairs of contacts when said indexing element has been deflected toward said corresponding pair of contacts by a predetermined degree, and an indexing disk provided with a plurality of teeth and dihedral notches, said indexing disk disposed in operable engagement with said indexing element to deflect said indexing element toward a selected one of said two pairs of contacts, said improvement comprising:

a housing comprised of a plurality of connecting walls forming an enclosure;

wherein said two pairs of contacts are inserted into a selected wall of said housing by having throughgoing terminals projecting through said wall and extending outside said enclosure of said housing;

a transmission gear disposed within said housing, said indexing disk coupled to said transmission gear;

wherein each pair of contacts is a contact spring assembly, each contact spring assembly being independent from another one of said two pairs of contacts;

wherein said indexing disk is disposed adjacent said pairs of contacts; and wherein said indexing element is a spiral spring, at least one end of said spiral spring being fixed with respect to said two pairs of contacts, said spiral spring characterized by a longitudinal axis, said longitudinal axis disposed in a direction parallel to said dihedral notches defined in said indexing disk, said spiral spring disposed adjacent to at least one of said dihedral notches of said indexing disk, said plurality of teeth and notches being alternately defined in said indexing disk, said indexing disk having a width and two adjacent teeth defining therebetween a dihedral notch, said teeth of said indexing disk contacting said spiral spring to laterally deflect said spiral spring to a selected one of said contact spring assemblies, whereby said selected one of said contact spring assemblies is actuated, whereby abrasion of said spiral spring and said indexing disk is minimized, whereby positive engagement is effectuated with said spiral spring and whereby reliable activation of said contact spring assembly is assured.

9. The improvement of claim 8 wherein said transmission gear is disposed between one wall of said housing and said indexing disk.

* * * * *